US005329221A

United States Patent [19]

Schauder

[11] Patent Number: 5,329,221

[45] Date of Patent: Jul. 12, 1994

[54] ADVANCED STATIC VAR COMPENSATOR CONTROL SYSTEM

[75] Inventor: Colin D. Schauder, Murrysville, Pa.

[73] Assignee: Electric Power Research Institute, Palo Alto, Calif.

[21] Appl. No.: 928,971

[22] Filed: Aug. 12, 1992

[51] Int. Cl.[5] ..... G05F 1/70

[52] U.S. Cl. ..... 323/207; 323/212; 363/97; 363/98

[58] Field of Search ..... 323/207, 212; 363/64, 363/131, 132, 97, 98; G05F 1/70

[56] References Cited

PUBLICATIONS

Edwards et al., "Advanced Static VAR Generator Employing GTO Thyristors," IEEE PES Winter Power Meeting, 1988, Paper No. 38WM109-1.

*Primary Examiner*—Emanuel T. Voeltz

*Attorney, Agent, or Firm*—Flehr, Hohbach, Test, Albritton & Herbert

[57] ABSTRACT

An advanced static VAR (volt ampere reactive) compensator (ASVC) system for coupling with and compensating a transmission line of a power system includes an ASVC controller. A voltage-sourced inverter has an AC side coupled through a series inductance to the transmission line, and a DC side coupled to a capacitor. By monitoring the DC side voltage, two line-to-line voltages and two line currents between the series inductance and the transmission lines, the ASVC controller determines an instantaneous reactive current component of the line current. The ASVC controller adjusts the phase angle of the inverter AC output voltages to compensates the transmission line by negating the instantaneous reactive current, and thus, the undesirable instantaneous reactive power on the transmission line. A method is also disclosed of compensating the instantaneous reactive power flowing over the transmission line.

22 Claims, 7 Drawing Sheets

ADVANCED STATIC VAR COMPENSATOR CONTROL SYSTEM

BACKGROUND OF THE INVENTION

The present invention relates generally to an advanced static VAR (volt amperes reactive) compensator (ASVC) control system, and more particularly to an ASVC control system including a method and an apparatus for compensating reactive power losses of alternating current (AC) power transmission lines.

Delivering power from a power generating station to the ultimate power consumers over long transmission power lines can be very costly for an electric utility. The electric utility passes on these costs to the ultimate consumers as higher electricity bills. These costs stem from two types of power losses. The first is a real power loss in watts from heating of the power lines, often referred to as "$I^2R$" losses. The second loss component stems from the magnetic effects of the power flowing through the transmission lines, which are referred to as inductive and capacitive losses. These inductive and capacitive losses affect a reactive component of the power which is measured in volt-ampere-reactive (VAR) units. These reactive (VAR) losses may be compensated using a static VAR compensator to more economically transmit power to the ultimate consumers and reduce their electricity bills.

Generally, static VAR compensators are based on the concept that inverters of various types can be connected between an AC power transmission line and an energy-storage device. The energy storage device may be an inductor or a capacitor. The static VAR compensator is operated to draw a purely reactive current from the power lines at its point of connection. Typically, the static VAR compensator has an inverter with gate-controlled power switching devices, such as gate turnoff thyristors (GTO). For transmission line implementations, the volt-ampere (VA) rating of the inverter is typically far higher than the rating normally encountered for industrial inverters.

The effect of a static VAR compensator is analogous to the well-known operation of a rotating synchronous condenser or a static VAR generator using thyristor-switched capacitors. Static VAR compensators are useful for maximizing the transmitted power and improving the stability of the utility system. Apart from the complexity of the power electronics of the inverter, the operation of a static VAR compensator under balanced, steady-state conditions is essentially identical to the operation of the rotating synchronous condenser when operating under steady-state conditions. However, the dynamic behavior of a static VAR compensator is more complicated than that of the rotating synchronous condenser. Previous static VAR compensators, rotating synchronous condensers, and static VAR generators have been unable to respond to the rapidly changing conditions of a dynamic power line disturbance, and thus, have performed poorly under dynamic conditions. Furthermore, the earlier static VAR compensators have been quite expensive, in terms of both initial manufacture and operational costs.

Thus, a need exists for an improved advanced static VAR compensator control system for compensating power lines to decrease power transmission costs, which is directed toward overcoming and not susceptible to, the above limitations and disadvantages.

SUMMARY OF THE INVENTION

According to one aspect of the present invention, an advanced static VAR compensator system is provided for coupling to a power line for compensating reactive power losses of the line. The control system has a voltage sourced inverter with a DC side and an AC side for coupling to the line. The inverter is responsive to an inverter phase angle control signal for drawing a selected magnitude of reactive power from the line. A series inductance may be coupled to the AC side of the inverter for coupling the inverter to the line. A voltage supporting device is coupled to the DC side of the inverter. An AC parameter sensor apparatus is coupled between the inverter and the line to monitor an electrical characteristic between the inverter and the line, such as a pair of line currents and a pair of line to line voltages. The system has a controller responsive to the AC parameter sensor apparatus for generating an instantaneous reactive current signal and for generating in response thereto the inverter phase angle control signal. A method of compensating a power line is also provided.

An overall object of the present invention is to provide an ASVC, including a method and an apparatus, for more economically and efficiently compensating reactive losses on power transmission lines.

Another object of the present invention is to provide an ASVC control system which is responsive to dynamic disturbances on the transmission lines.

A further object of the present invention is to provide an ASVC which provides fast and stable dynamic control of instantaneous reactive current drawn from the transmission line.

An additional object of the present invention is to provide an ASVC control system for providing dynamic control using a lower cost power circuit than the previous static VAR generators.

The present invention relates to the above features and objects individually as well as collectively. These and other objects, features and advantages of the present invention will become apparent to those skilled in the art from the following description and drawings.

DETAILED DESCRIPTION OF A PREFERRED EMBODIMENTS

Figure 1:
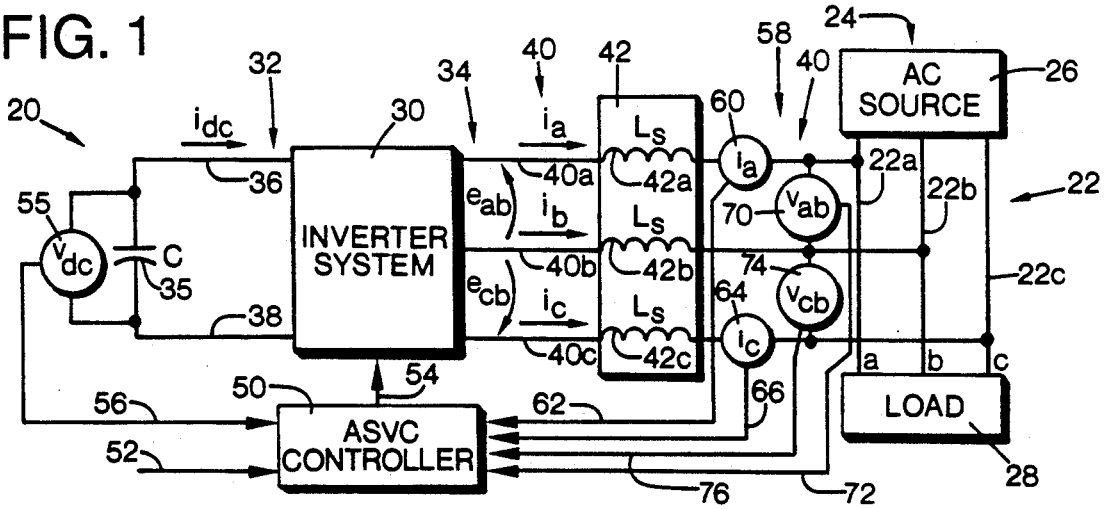
FIG. 1 is a schematic block diagram of one form of an ASVC system of the present invention.

FIG. 1 illustrates an embodiment of an advanced static VAR (ASVC) system 20 constructed in accordance with the present invention for compensating reactive losses on a polyphase power line, such as a three phase utility distribution or transmission line 22 having phases 22*a*, 22*b*, and 22*c*. The line 22 forms a portion of an AC power system 24, with the line 22 delivering power from an AC source 26, such as a power generation station, to a load 28 of the ultimate power consumer(s). While the ASVC system 20 is illustrated in use with a transmission power line 22, the ASVC system 20 may also be used in other applications, such as with distribution systems or industrial loads to improve the power factor of the power drawn by the load.

The ASVC system 20 includes an inverter system, such as a simple voltage sourced inverter 30, defined herein as an inverter having only frequency or phase angle control capability, or a structurally equivalent inverter as known by those skilled in the art. "Frequency control" merely refers to control in the time domain of cycles per second or Hertz; whereas "phase angle control" refers to the same quantity but in terms applicable to vector analysis of the power parameters. It is apparent that a dual control voltage sourced inverter having full vector control, that is, an inverter having both magnitude and frequency or phase angle control capability, such as a pulse width modulated inverter or a notched waveform inverter, may be used. In the preferred embodiment, a simple inverter 30 is advantageously used to realize significant cost savings, both in initial manufacture and operational costs. However, no earlier static VAR compensator known to the inventor was capable of using the simple inverter 30 having only one degree of control to provide fast dynamic control of the current, on the order of one quarter of a cycle from a fully inductive to a fully capacitive mode.

The inverter 30 has a DC side 32 and a three phase AC side 34. A voltage supporting device 35, such as a capacitor C, is coupled to the inverter DC side 32 by conductors 36 and 38. Besides the illustrated capacitor C, the voltage supporting device 35 may be any device having a defined DC voltage and a low source impedance, such as devices providing a power flow to the DC side 32, batteries, magnetic power storage systems, or other devices which return power to the DC side 32.

The inverter AC side 34 is coupled to line 22 by a three phase coupling conductor 40. The conductor 40 has three single phase coupling conductors 40*a*, 40*b* and 40*c* which are coupled to the respective single phase lines 22*a*, 22*b* and 22*c*. The ASVC system 20 includes a series inductance in series with the inverter AC side 34 and the power line 22. In the illustrated embodiment, the ASVC system 20 includes a conventional power transformer 42 which introduces an $L_s$ series inductance 42*a*, 42*b* and 42*c* into the respective coupling conductors 40*a*, 40*b* and 40*c*. Alternatively this series inductance $L_s$ may be introduced into the ASVC system by adding a series inductor (not shown) to the coupling conductor 40, or by interphase transformers (not shown) supplied with the inverter 30.

The ASVC system 20 also includes an ASVC controller 50 which operates as described further below in response to an operator input 52 and a variety of system inputs to generate an inverter control signal 54 for controlling the inverter 30. On the inverter DC side 32, the ASVC system 20 has a DC power flow parameter monitor, such as a DC voltage sensor or voltmeter 55. The DC voltage sensor 55 monitors the voltage across capacitor 35, and in response thereto, provides a $v_{dc}$ voltage signal 56 to the controller 50.

The ASVC system 20 has an AC parameter monitoring apparatus 58 coupled between the transmission line 22 and the inverter 30 for monitoring one or more electrical characteristics, such as voltage, current, power factor or the like, between the transmission line 22 and the inverter 30. For example, on the inverter AC side 34, currents $i_a$, $i_b$ and $i_c$ flow through the respective coupling lines 40*a*, 40*b* and 40*c*, with the positive direction of current flow assumed to be from the inverter 30 to the transmission lines 22. The controller 50 may operate in response to only two of the phase currents flowing through conductors 40, and two of the line to line voltages between conductors 40*a*, 40*b* and 40*c*. Thus, the illustrated AC parameter monitoring apparatus 58 includes two current sensors and two voltage sensors.

In the illustrated embodiment, an $i_a$ current sensor or ammeter 60 monitors the $i_a$ current flowing through line 40*a*, and in response thereto, provides an $i_a$ current signal 62 to the controller 50. An $i_c$ current sensor or ammeter 64 monitors the $i_c$ current flowing through the coupling conductor 40*c*, and in response thereto, provides an $i_c$ current signal 66 to the controller 50.

The ASVC system 20 has a $v_{ab}$ voltage sensor or voltmeter 70 monitoring the voltage between the coupling conductors 40*a* and 40*b*, and in response thereto, providing a $v_{ab}$ voltage signal 72 to the controller 50. A $v_{cb}$ voltage sensor or voltmeter 74 monitors the voltage between the coupling conductors 40*c* and 40*b*, and in response thereto provides a $V_{cb}$ voltage signal 76 to the controller 50. By monitoring the line to line voltages between conductors 40*a*, 40*b* and 40*c* on the transmission line side of transformer 42 (and of the series inductance $L_s$), the ASVC system 20 monitors the line to line voltage of the transmission line 22. Thus, sensor 70 monitors the voltage between transmission lines 22*a*and 22*b*, while sensor 74 monitors the voltage between transmission lines 22*c* and 22*b* when the ASVC system 20 is coupled to the transmission line 22.

For transmission line applications, the volt-ampere (VA) rating of the power electronics of the inverter 30 and transformer 42 are typically large, so the inverter and transformer constitute the main cost of the ASVC system 20. One economical arrangement of these elements is a single standard main transformer fed from a plurality of elementary six-pulse inverters. The outputs of the six-pulse inverters may be combined through various low-rating interphase transformers (not shown). In such an arrangement, the series inductance $L_s$ comprises the total series inductance of the interphase transformers and the main transformer 42.

Unfortunately, the optimum power circuit of the simple inverter 30 cannot be freely controlled as a three phase voltage source. Rather, only the phase angle of the inverter AC-side output voltages can be directly controlled. The magnitude of the inverter AC-side output voltages is always proportional to the prevailing $v_{dc}$ capacitor voltage as monitored by sensor 55 on the DC side 32 of inverter 30. Despite this restriction which makes control of the simple inverter 30 more difficult, the controller 50 and method of controlling the ASVC system 20, as described further below, have proven to provide excellent dynamic control capability in scale model testing. The efficiency of the ASVC controller 50, and the low cost of the inverter power circuit, yields an ASVC system 20 with the ability to successfully compete against known alternative VAR compensation methods. For example, with a closed loop control bandwidth set to approximately 200 radians per second, the ASVC system 20 may swing from a fully inductive mode to a fully capacitive mode in slightly more than a quarter of a cycle of the frequency of the line 22.

Equivalent Circuit

Figure 2:
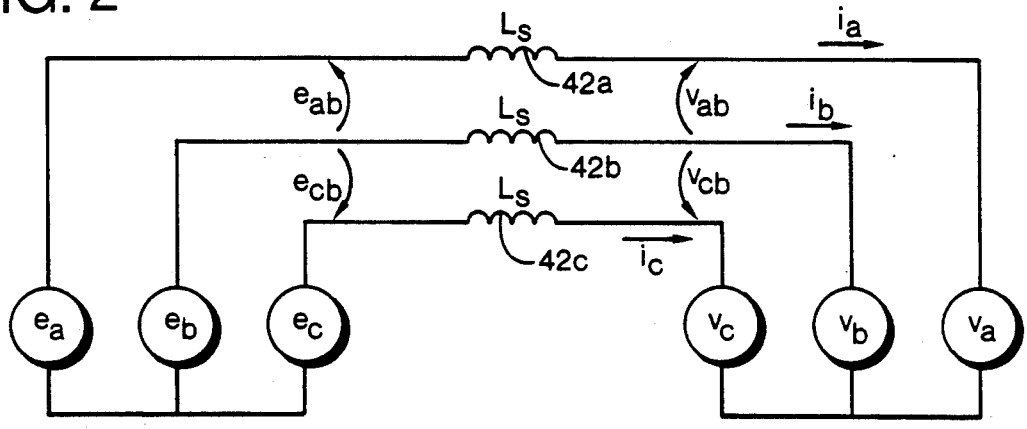
FIG. 2 is a schematic diagram of an equivalent circuit of the AC side of the ASVC system of FIG. 1.

Referring to FIG. 2, the main dynamic aspects of the ASVC system 20 of FIG. 1 are represented schematically as an equivalent circuit taken from the AC side 32 of inverter 30. The inverter terminal line voltages on the AC side 34 are shown as the voltage sources labeled $e_a$, $e_b$ and $e_c$, with the line to line voltages of interest being labeled as $e_{ab}$ and $e_{cb}$. The line voltages of the transmission line 22 are shown as the voltage sources labeled $v_a$, $v_b$ and $v_c$. The line to line voltages of the transmission line monitored by voltage sensors 70 and 74 are labeled as $V_{ab}$ and $V_{cb}$, respectively.

The FIG. 2 equivalent circuit defines the polarity conventions for the various voltages and currents of interest. The positive portions of the line-to-line voltages $e_{ab}$, $e_{cb}$, $v_{cb}$ and $v_{cb}$ are indicated by the arrowheads adjacent each label. The line currents $i_a$, $i_b$ and $i_c$ have a positive direction of flow as indicated by the arrows adjacent thereto. The equivalent circuit of FIG. 2 is useful in explaining the operation of the ASVC system 20.

AC-Side Equations

Figure 3:
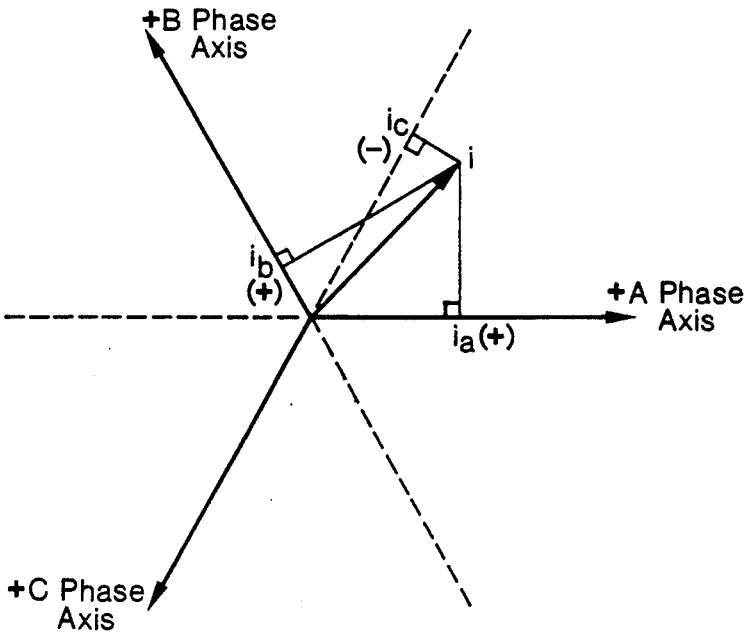
FIG. 3 is a vector diagram used to describe the operation of the ASVC system of FIG. 1.

Referring to FIG. 2, all of the dynamics of the transmission line 22 may be summarized in the instantaneous values of the line to line voltages $v_{ab}$ and $v_{cb}$ at the tie point between the ASVC system 20 and the transmission line 22. Similarly, all of the dynamics of the inverter 30 lay behind the inverter AC side terminal voltages $e_{ab}$ and $e_{cb}$. FIG. 3 is a phasor diagram of the instantaneous phase variables of the symmetrical components of the instantaneous reactive current used to describe the operation of the ASVC system 20 of FIG. 1. In terms of the instantaneous variables shown in FIG. 2, the circuit equations may be written as follows:

$$(e_{ab} - v_{ab}) = 2L_s\frac{di_a}{dt} + L_s\frac{di_c}{dt}$$

-continued $$(e_{cb} - v_{cb}) = L_s\frac{di_a}{dt} + 2L_s\frac{di_c}{dt}$$

In matrix notation, the two equations above may be expressed as:

$$(p)\begin{bmatrix} i_a \\ i_c \end{bmatrix} = \frac{1}{3L_s}\begin{bmatrix} 2 & -1 \\ -1 & 2 \end{bmatrix}\begin{bmatrix} (e_{ab} - v_{cb}) \\ (e_{cb} - v_{vb}) \end{bmatrix}$$

The instantaneous power delivered to the transmission line 22 at the point of connection with the ASVC system 20 may be expressed, using the lower case letter "p" in parenthesis to indicate the derivative operator, i.e., (p) =d/dt, as follows:

Instantaneous Real Power $$p = v_{ab}i_a + v_{cb}i_c$$

$$p = v_a i_a + v_b i_b + v_c i_c$$

In contrast with the earlier classical VAR generators, the ASVC system 20 advantageously has the intrinsic ability to exchange real power (P in watts) with the transmission line 22. Because the inverter 30 and the DC side capacitor 35 have no sizable power sources or sinks, the real power P is controlled to a value which is zero on the average. The value of the real power P departs from zero only to bring about corrections of the DC side capacitor voltage $v_{dc}$ as monitored by sensor 55.

One of the main control functions of the ASVC system 20 is to draw a component of current from the transmission line 22 which is not associated with any real power flow. While the notion of reactive power (Q in VARs) is well known in the phasor sense, traditional phasor analysis applies only to single-frequency sinusoidal quantities. Furthermore, the associated reactive power Q concept is restricted to balanced three phase phasor sets.

The ASVC system 20 compensates the transmission line 22 even during line disturbances, using a fast and stable dynamic control system which operates in response to an instantaneous reactive current drawn from line 22. In order to study and control the dynamics of the ASVC system 20 within a sub-cycle time frame including line distortions, disturbances and unbalance, a definition of reactive current and the associated reactive power Q, which is valid on an instantaneous basis, is given a broader definition herein than in traditional reactive power phasor analysis. To distinguish this new analysis and associated control from the traditional definitions, the new concept is referred to as "instantaneous reactive current, " and "instantaneous reactive power". Here, the instantaneous reactive current is defined as a portion of the total current in each of the three phases that may be eliminated at any instant without altering the instantaneous real power P. This instantaneous reactive current may be obtained through a vectorial interpretation of the instantaneous values of the circuit variables shown in FIG. 2.

Vector Representation of the Instantaneous Three phase Quantities

Referring to FIG. 3, an instantaneous current or voltage vector, here a current vector i, may be uniquely represented by a single point in a plane at which the vector i ends. Using this terminal point, a set of three instantaneous phase variables $i_a$, $i_b$ and $i_c$ may be used to uniquely define the current vector i. These instantaneous phase variables $i_a$, $i_b$ and $i_c$ are defined by a perpendicular projection of the terminal point of vector i onto each of the three symmetrically disposed phase axes A, B and C. These three instantaneous phase variables $i_a$, $i_b$ and $i_c$ sum to zero. As the current vector i moves around the plane describing various trajectories, the values of the phase variables $i_a$, $i_b$ and $i_{ac}$ also change to define the absolute value (magnitude) and angle of the vector i. Since the vector i contains all of the information about the three phase set, here of currents, the phase variables $i_a$, $i_b$ and $i_c$ may be used to interpret this vector information, including steady-state unbalance, harmonic waveform distortions, and transient components.

Figure 4:
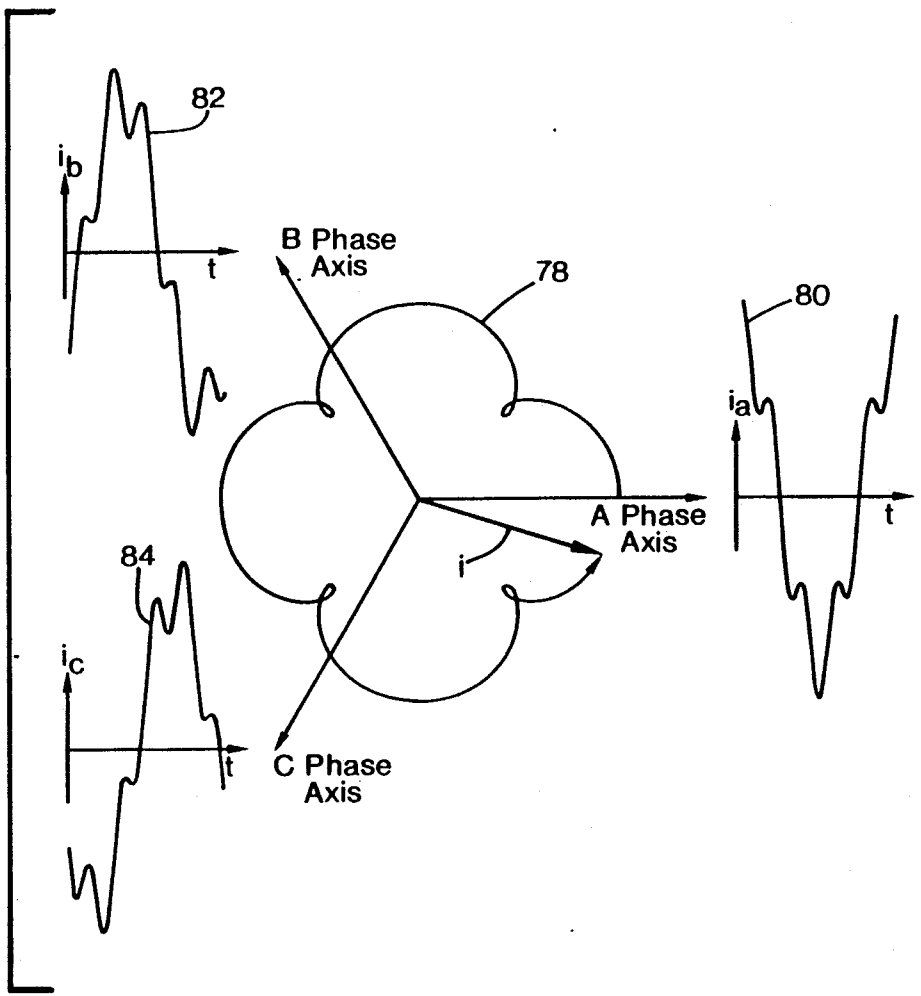
FIG. 4 is a graph of the vector trajectory for a three phase ASVC system with severely distorted harmonic phase variables.

Referring to FIG. 4, the travel of the current vector i is graphically illustrated as a vector trajectory curve 78 for a three phase system suffering severe harmonic distortion, here, comprising 25% of the fifth harmonic. Adjacent each of the phase axes A, B and C, are graphs 80, 82 and 84 of the respective associated phase variables $i_a$, $i_b$ and $i_c$ over the period of time illustrated by curve 78.

Figure 5:
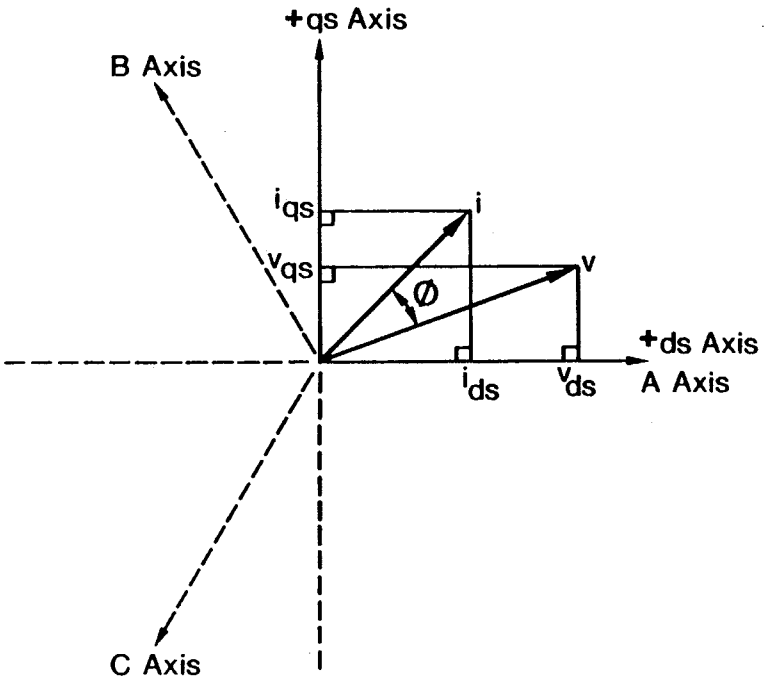
FIG. 5 is a vector diagram of the instantaneous power coordinates for the ASVC system of FIG. 1 shown in a cartesian coordinate system having ds and qs axes.

Referring to FIG. 5, the current vector i of FIG. 3 is shown as having instantaneous components in a cartesian coordinate system. In FIG. 5 the current vector i is described in terms of the perpendicular projections $i_{ds}$ and $i_{qs}$ onto the respective direct and quadrature axes, ds and qs. The mathematical transformation from the phase variables $i_a$ and $i_c$ (as monitored by sensors 60 and 64) to the ds and qs cartesian coordinates may be defined as:

$$\begin{bmatrix} i_{ds} \\ i_{qs} \end{bmatrix} = \begin{bmatrix} 1 & 0 \\ \frac{-1}{\sqrt{3}} & \frac{-2}{\sqrt{3}} \end{bmatrix} \begin{bmatrix} i_a \\ i_c \end{bmatrix}$$

FIG. 5 also shows a voltage vector v which has cartesian values $v_{ds}$ and $v_{qs}$. If the voltage vector v represents a line-to-line voltage, the transformation from the phase variables $v_{ab}$ and $v_{cb}$ (as monitored by sensors 70 and 74) may be transformed into direct and quadrature components according to:

Vector Resolver Equations $$\begin{bmatrix} v_{ds} \\ v_{qs} \end{bmatrix} = \begin{bmatrix} \frac{2}{3} & \frac{-1}{3} \\ 0 & \frac{-1}{\sqrt{3}} \end{bmatrix} \begin{bmatrix} v_{ab} \\ v_{cb} \end{bmatrix}$$

Figure 6:
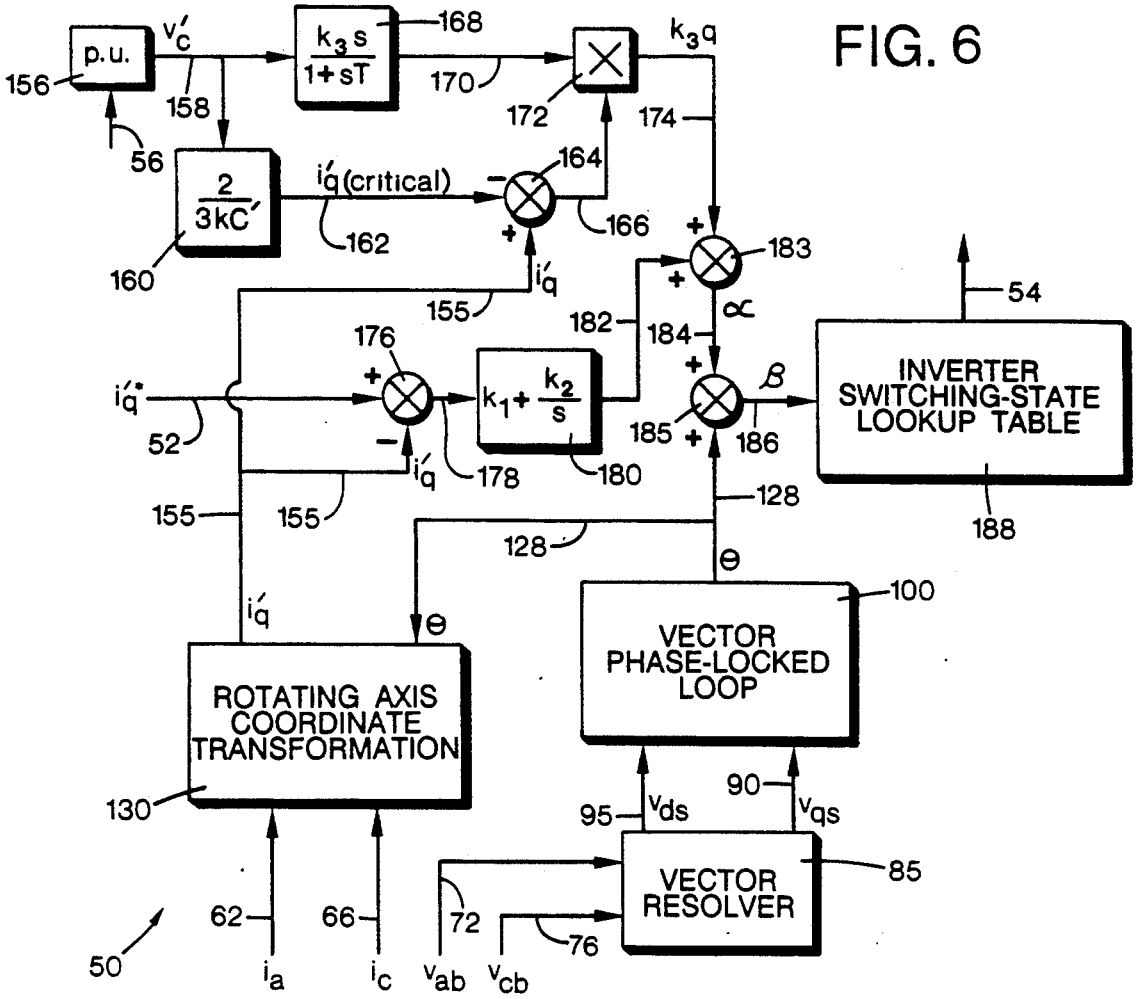
FIG. 6 is a block diagram of one form of an ASVC controller for the ASVC system of FIG. 1.
Figure 7:
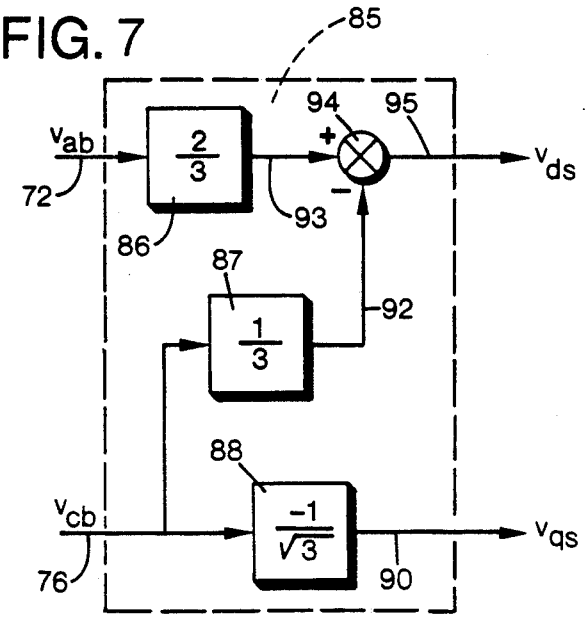
FIG. 7 is a block diagram of the vector resolver portion of the ASVC controller of FIG. 6.

FIG. 6 illustrates a preferred embodiment of the ASVC controller 50 which includes a vector resolver portion 85, which is shown in greater detail in FIG. 7. The vector resolver portion 85 receives the $V_{ab}$ and $V_{cb}$ line to line voltage signals 72 and 76 from the respective voltage sensors 70 and 74. According to the vector resolver equations above, multiplier portions 86, 87 and 88 apply their respective multipliers as shown in FIG. 7 to the $v_{ab}$ and $v_{cb}$ signals 72 and 76. The output of multiplier portion 88 is a $v_{qs}$ quadrature voltage signal 90. A one third $v_{vb}$ signal 92 is output from multiplier portion 87, and a two thirds $v_{ab}$ signal 93 is output from multiplier portion 86. The one third $v_{cb}$ signal 92 is subtracted from the two thirds $v_{ab}$ signal 93 by a comparator portion 94 to provide a $v_{ds}$ direct voltage signal 95. The vector resolver portion 85 may be implemented in a variety of ways, such as in analog or digital hardware or software, or combinations thereof, as well as other structurally equivalent forms known to those skilled in the art.

Referring again to FIG. 5, this vector representation of voltage and current may be used to define instantaneous reactive current and "power." The voltage vector v represents the transmission line voltage at the point of interconnection between the ASVC system 20 and the transmission line 22. The current vector v of FIG. 5 describes the AC current flowing through the ASVC coupling conductors 40. When the variables in the equation for the instantaneous power P are replaced by the equivalent cartesian ds and qs coordinates, the following equations may be used to describe the instantaneous power P:

Instantaneous Real Power $$P = v_{ab}i_a + v_{cb}i_c$$

$$P = \frac{3}{2}(v_{ds}i_{ds} + v_{qs}i_{qs})$$

$$P = \frac{3}{2}(|v||i|\cos(\phi))$$

In these equations, $\phi$ is the instantaneous angle between the voltage and the current vectors, v and i.

Only the component of the instantaneous current vector i which is in phase with the instantaneous voltage vector v contributes to the instantaneous real power P. The remaining current component may be removed without changing the real power P, and thus, this remaining current component is the instantaneous reactive current. From these observations, the instantaneous reactive power Q may be defined as:

Instantaneous Reactive Power $$Q = \frac{3}{2}|v||i|\sin(\phi)$$

$$Q = \frac{3}{2}(v_{ds}i_{qs} - v_{qs}i_{ds})$$

The constant 3/2 is chosen so that the definition for Q coincides with the classical phasor definition under balanced steady-state conditions.

Figure 8:
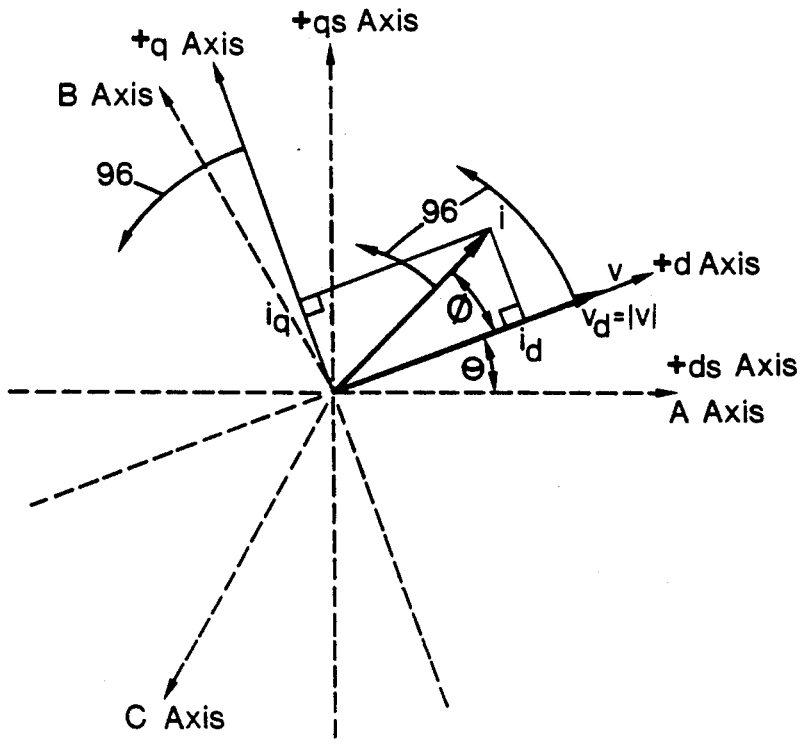
FIG. 8 is a vector diagram of the ASVC system of FIG. 1 with a cartesian coordinate system having the d axis coincident with the instantaneous voltage vector v and the q axis in quadrature therewith.
Figure 9:
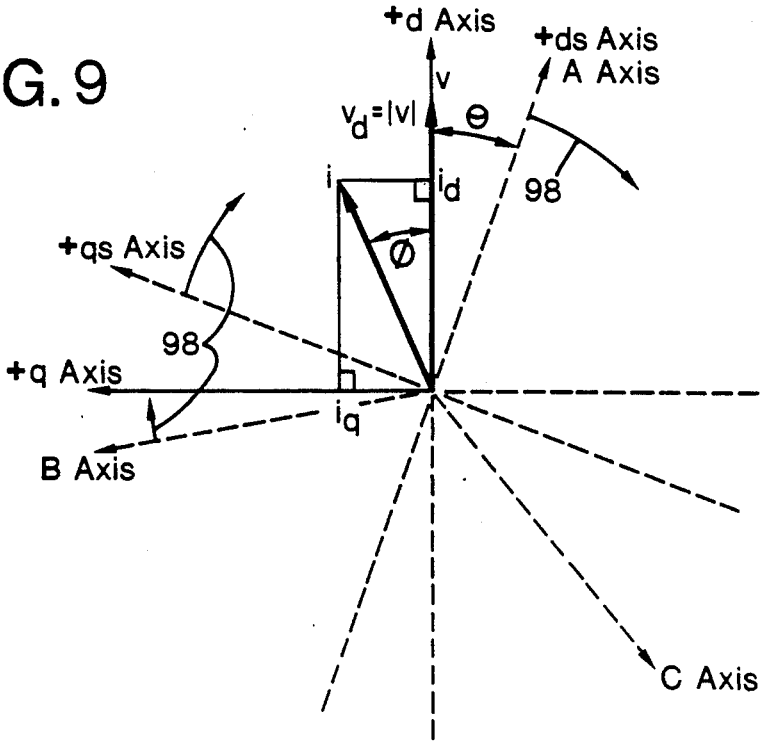
FIG. 9 is a vector diagram of the ASVC system of FIG. 1 with the d axis directed upwardly.

Referring to FIGS. 8 and 9, the vector coordinate frame may be further manipulated to obtain a separation of phase variables which is more useful for power control by the ASVC system 20. In FIG. 8, a new cartesian coordinate system is defined with the direct d axis coincident with the instantaneous voltage vector v, and the quadrature q axis perpendicular to the voltage vector v. In this voltage-referenced coordinate frame, the current vector coordinates have a special significance. The current vector coordinates along the d axis correspond to the instantaneous real power P, and the current vector coordinates along the q axis correspond to the instantaneous reactive current.

Furthermore, the d and q axes are not stationary in the plane, but rather rotate with the trajectory of the voltage vector v. Thus, the d and q coordinates constitute a synchronously rotating reference frame, (with the reference stationary frame indicated by the subscript letter "s"), and as defined by the time varying transformation equations:

Synchronous Reference Frame Transformation $$\begin{bmatrix} i_{ds} \\ i_{qs} \end{bmatrix} = \begin{bmatrix} \cos(\theta) & -\sin(\theta) \\ \sin(\theta) & \cos(\theta) \end{bmatrix} \begin{bmatrix} i_d \\ i_q \end{bmatrix}$$

$$\theta = \tan^{-1}(v_{qs}/v_{ds})$$

$$P = \frac{3}{2}\,|v|\,i_d$$

$$Q = \frac{3}{2}\,|v|\,i_q$$

Under balanced steady-state conditions, the coordinates of the voltage and current vectors v, i in the synchronous reference frame are all constant quantities. This analysis proves to be a useful feature for analyzing and decoupling control of the two current components, and thus for decoupling and analyzing the two power components P and Q.

In the FIG. 9 phasor diagram, the vectors and coordinate axes of FIG. 8 have been rotated so the voltage vector v and the direct d axis which is colinear therewith are always pointing in an upward position. The plane now rotates backward, i.e., clockwise, relative to the direct and quadrature d, q axes as the voltage vector v moves through time. For example, in FIG. 8, the vectors v and i rotate counterclockwise as indicated by the curved arrows 96, whereas in FIG. 9, the A, B and C axes, as well as the ds and qs axes, rotate in a clockwise direction as indicated by arrows 98.

Thus, the point of view in FIG. 9 has changed from the stationary plane of FIG. 8 with a rotating voltage vector to instead, a stationary voltage vector with a synchronously rotating reference frame. The instantaneous to d-q values transformation equations which relate the direct and quadrature current components $i_d$ and $i_q$ back to the instantaneous phase currents $i_a$ and $i_c$ are as follows:

Vector Phase-Locked Loop and Rotating Axis Coordinate Transformation Equations $$\theta = \tan^{-1}(v_{qs}/v_{ds})$$

$$\begin{bmatrix} i_d \\ i_q \end{bmatrix} = -\frac{2}{\sqrt{3}} \begin{bmatrix} \sin\left(\theta - \frac{\pi}{3}\right) & \sin(\theta) \\ \cos\left(\theta - \frac{\pi}{3}\right) & \cos(\theta) \end{bmatrix} \begin{bmatrix} i_a \\ i_c \end{bmatrix}.$$

Figure 10:
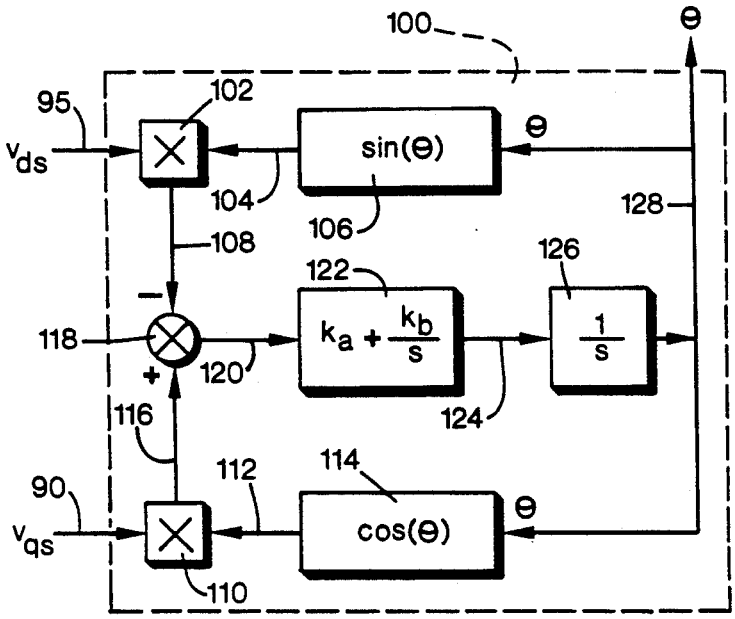
FIG. 10 is a block diagram of the vector phase-locked loop portion of the ASVC controller of FIG. 6.

The illustrated ASVC controller 50 in FIG. 6 has a vector phase locked loop portion 100, which is shown in greater detail in FIG. 10. The vector phase locked loop portion 100 receives the $v_{qs}$ quadrature voltage signal 90 and the $v_{ds}$ direct voltage signal 95 from the vector resolver portion 85. A first multiplier portion 102 receives a sin Θ signal 104 from a sin Θ generator portion 106, and multiplies the sin Θ signal 104 with the $v_{ds}$ signal 95 to produce a $v_{ds}$ sin Θ signal 108. A second multiplier portion 110 receives a cos Θ signal 112 from a cos Θ generator portion 114, and multiplies the cos Θ signal 112 with the $v_{qs}$ signal 90 to produce a $v_{qs}$ cos Θ signal 116. The $v_{ds}$ sin Θ signal 108 is subtracted from the $v_{qs}$ cos Θ signal 116 by a comparator portion 118 to provide a ($v_{qs}$cos Θ−$v_{ds}$sin Θ) difference signal 120. The difference signal 120 is processed through a ($k_a+k_b/s$) function portion 122 which provides an output signal 124 to a (1/s) function portion 126. The output of the (1/s) function portion 126 is a Θ signal 128, which represents the angle e between the ds axis, or phase A axis, and the d axis or line voltage vector v, as shown in FIGS. 8 and 9.

Figure 11:
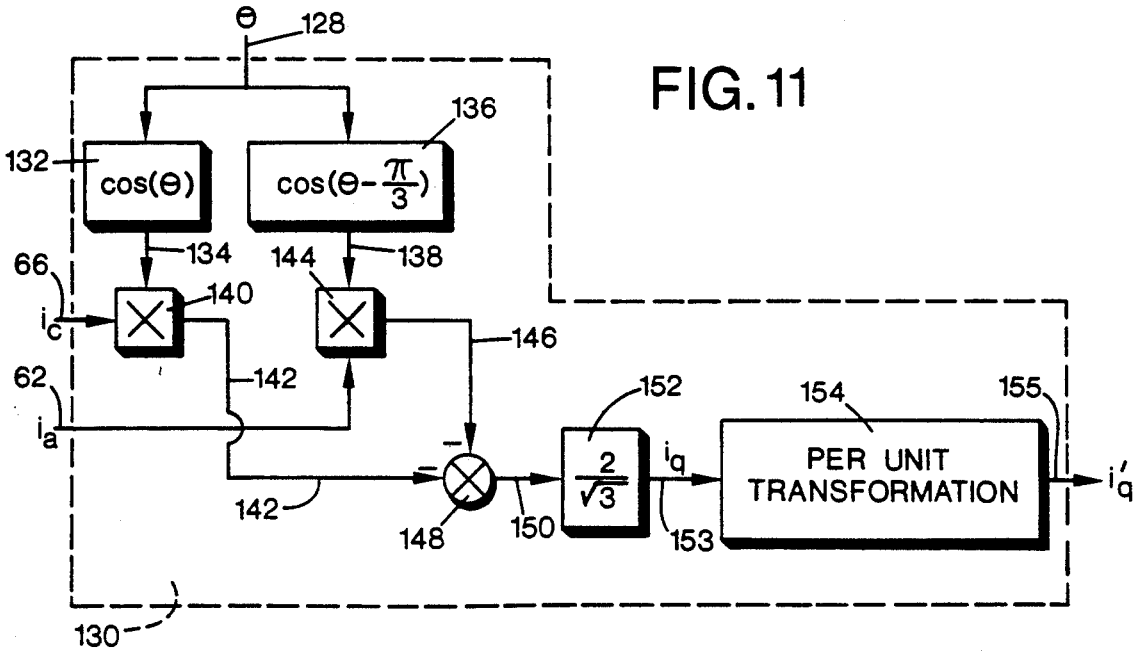
FIG. 11 is a block diagram of one form of a rotating axis coordinate transformation portion of the ASVC controller of FIG. 6.

In FIG. 6, the illustrated ASVC controller 50 has a rotating axis coordinate transformation portion 130, which is shown in greater detail in FIG. 11, to implement the rotating axis coordinate transformation equations. The transformation portion 130 receives the Θ signal 128 from the vector phase locked loop portion 100. A cos Θ generator portion 132 produces a cos Θ output signal 134 in response to the Θ signal 128. A cos (Θ−π/3) generator portion 138 produces a cos (Θ−π/3) signal 138 in response to the Θ signal 128.

The transformation portion 130 receives the $i_a$ and $i_c$ current signals 62 and 66 from the respective current sensors 60 and 64. A first multiplier function portion 140 multiplies the cos Θ output signal 134 with the $i_c$ current signal 66 to provide an $i_c$ cos Θ product signal 142. A second multiplier function portion 144 multiplies the cos (Θ−π/3) signal 138 with the $i_a$ current signal 62 to provide an $i_a$ cos (Θ−π/3) product signal 146. A comparator portion 148 sums the negative of the $i_c$ cos Θ product signal 142 with the negative of the $i_a$ cos (Θ−π/3) product signal 146 to provide a summation signal 150. A multiplier portion 152 applies its multiplier as shown in FIG. 11 to the summation signal 150 to provide an $i_q$ output signal 153. The transformation portion 130 may include a per unit transformation portion 154 which receives the $i_q$ output signal 153 and transforms it into an $i_q'$ signal 155 representative of the per unit value of the $i_q$ output signal 153 in the manner known to those skilled in the art.

Thus, together the vector resolver portion 85, the vector phase locked loop portion 100, and the rotating axis coordinate transformation portion 130, or their structural equivalents known to those skilled in the art, may be considered as an input portion of the illustrated controller 50. The vector phase locked loop portion 100 and the rotating axis coordinate transformation portion 130 may be implemented in a variety of ways, such as in analog or digital hardware or software, or combinations thereof, as well as other structurally equivalent forms known to those skilled in the art.

ASVC AC-Side Equations in the Synchronous Reference Frame

Having described instantaneous current and voltage vectors i and v, instantaneous reactive current Q, and the synchronously rotating reference frame of FIG. 9, a mathematical model of the ASVC system 20 is now developed. The AC circuit equations in matrix form were developed above with respect to FIG. 2. The AC circuit matrix equations involve the ASVC line currents $i_a$ and $i_c$ monitored by sensors 60 and 64, and the line to line voltages $v_{ab}$ and $v_{cb}$ monitored by sensors 70 and 74.

The equations below are used to transform these quantities into the synchronous reference frame:

AC Side Equations $$(p)\begin{bmatrix} i_a \\ i_c \end{bmatrix} = \frac{1}{3L_s}\begin{bmatrix} 2 & -1 \\ -1 & 2 \end{bmatrix}\begin{bmatrix} (e_{ab} - v_{ab}) \\ (e_{cb} - v_{cb}) \end{bmatrix}$$

$$[C] = \begin{bmatrix} \cos(\theta) & -\sin(\theta) \\ \cos\left(\theta + \frac{2\pi}{3}\right) & -\sin\left(\theta + \frac{2\pi}{3}\right) \end{bmatrix}$$

$$\begin{bmatrix} v_a \\ v_c \end{bmatrix} = [C]\begin{bmatrix} v_d \\ v_q \end{bmatrix}$$

$$\begin{bmatrix} e_a \\ e_c \end{bmatrix} = [C]\begin{bmatrix} e_d \\ e_q \end{bmatrix}$$

$$\begin{bmatrix} i_a \\ i_c \end{bmatrix} = [C]\begin{bmatrix} i_d \\ i_q \end{bmatrix}$$

$$\begin{bmatrix} v_{ab} \\ v_{cb} \end{bmatrix} = \begin{bmatrix} 2 & 1 \\ 1 & 2 \end{bmatrix}\begin{bmatrix} v_a \\ v_c \end{bmatrix}$$

$$\begin{bmatrix} e_{ab} \\ e_{cb} \end{bmatrix} = \begin{bmatrix} 2 & 1 \\ 1 & 2 \end{bmatrix}\begin{bmatrix} e_a \\ e_c \end{bmatrix}$$

$$(p)\begin{bmatrix} i_d \\ i_q \end{bmatrix} = \begin{bmatrix} 0 & \omega \\ -\omega & 0 \end{bmatrix}\begin{bmatrix} i_d \\ i_q \end{bmatrix} + \frac{1}{L_s}\begin{bmatrix} (e_d - |v|) \\ e_q \end{bmatrix}$$

where $$\omega = \frac{d\theta}{dt} \text{ and } \theta = \tan^{-1}\left(\frac{v_{qs}}{v_{ds}}\right)$$

Where the lower case letter p in parenthesis represents the derivative operator, that is, (p)=d/dt.

Figure 12:
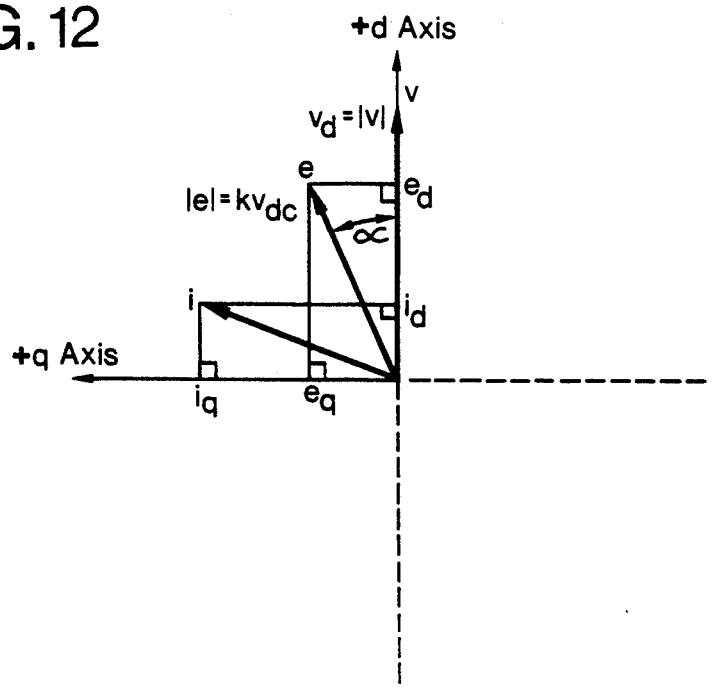
FIG. 12 is a vector diagram of the ASVC system of FIG. 1 in a synchronous reference frame.

Referring to FIG. 12, one preferred vector system is defined for synchronous reference frame analysis by the ASVC system 20. As in FIG. 9, the d axis is defined as being colinear with the voltage vector v, and the q axis is perpendicular thereto. Between the current vector i and the voltage vector v lies the voltage vector e corresponding to the voltage at the AC terminals of the inverter 30 as illustrated in FIG. 2. The magnitude |e| of the voltage vector e is defined as the product of a constant k and the inverter DC voltage $v_{dc}$ as measured by sensor 55. The constant k for the inverter 30 relates the voltage $v_{dc}$ on the DC side 32 to an amplitude or peak of the line to neutral voltage at the terminals of the inverter AC side 34. The direct and quadrature components of the voltage vector e are defined as $e_d$ and $e_q$, respectively. The angle between the voltage vector v and the voltage vector e is defined is $\alpha$. Note, the phase A, B and C axes rotate as shown in FIG. 9, but have been omitted for clarity from FIG. 12.

Figure 13:
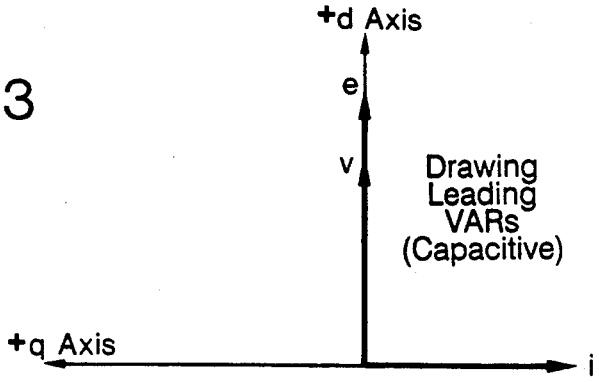
FIG. 13 is a graph of the capacitive reactance voltages and currents of FIG. 2 under normal steady-state operating conditions.
Figure 14:
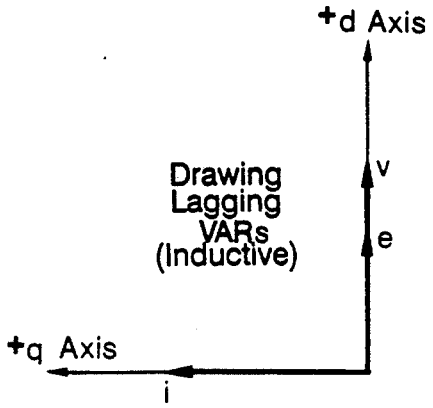
FIG. 14 is a graph of the inductive reactance voltages and currents of FIG. 2 under normal steady-state operating conditions.

FIGS. 13 and 14 illustrate the current and voltage vectors under normal steady-state operation using the reference frame of FIG. 12. In FIG. 13, the capacitive reactance mode is illustrated. Here, the instantaneous reactive current is negative, and the ASVC system 20 appears to the transmission line 22 as a large capacitor. The voltage vectors e and v are in phase and the magnitude of inverter voltage vector e is greater than that of the line voltage vector v. The voltage vectors e and v lead the phase current vector i. Thus, in FIG. 13, the ASVC system 20 is drawing leading or capacitive VARs from the transmission line 22.

In FIG. 14, the inductive reactance mode is shown. Here, the instantaneous reactive current is positive, and the ASVC system 20 appears to the transmission line 22 as a large inductor. The voltage vectors e and v are again in phase, but now the magnitude of line voltage vector v is greater than that of the inverter voltage vector e. Now the phase current vector i leads the voltage vectors e and v. Thus, in FIG. 14, the ASVC system 20 is drawing lagging or inductive VARs from the transmission line 22.

Inclusion of Inverter and DC-side circuit Dynamics

Thus far, the model of the ASVC system has included only components on the inverter AC side 34. To complete the model of the ASVC system 20, the dynamics of the inverter 30 and of the circuit on the inverter DC side 32 may be included. The simple voltage sourced inverter 30 may be modeled as a generalized lossless voltage transformer. Such an approach allows an additional equation to be written, assuming an instantaneous balance between the power at the terminals on the DC side 32 and the AC side 34. Thus, the inverter 30 may be modeled according to the following power balance equations:

Power Balance Equations $$v_{dc}i_{dc} = e_{ab}i_a + e_{cb}i_c$$

$$v_{dc}i_{dc} = \frac{3}{2}(e_d i_d + e_q i_q)$$

In this generalized model of the inverter 30, any voltage harmonics produced by the inverter are neglected. Thus, the direct and quadrature components $e_d$ and $e_q$ of the voltage vector e at the terminals of the inverter AC side 34 may be defined as follows to provide the dynamic equations for the inverter DC side 32:

DC Side Dynamic Equations $$e_d = k v_{dc}\cos(\alpha)$$

$$e_q = k v_{dc}\sin(\alpha)$$

In these equations, k is the constant as defined above for relating the inverter DC side voltage to the amplitude (peak) of the line to neutral voltage on the inverter AC side 34. The angle $\alpha$ is shown in FIG. 12 as the angle by which the inverter voltage vector e leads the line voltage vector v.

Substituting these expressions for $e_d$ and $e_q$ into the power balance equation above and introducing the effects of the DC side capacitor 35, the following equation is obtained for use in defining the equation below:

DC Side Contribution $$(p)\, v_{dc} = \frac{3k}{2C}\,[-i_d\cos(\alpha) - i_q\sin(\alpha)]$$

This equation is then incorporated into the previous model of the circuit on the AC side 34 to provide the following state equation:

d-q State Equations $$(p)\begin{bmatrix} i_d \\ i_q \\ v_{dc} \end{bmatrix} = \begin{bmatrix} 0 & \omega & 0 \\ -\omega & 0 & 0 \\ 0 & 0 & 0 \end{bmatrix}\begin{bmatrix} i_d \\ i_q \\ v_{dc} \end{bmatrix} + \frac{1}{L_s}\begin{bmatrix} kv_{dc}\cos(\alpha) - |v| \\ kv_{dc}\sin(\alpha) \\ \frac{-3kL_s}{2C}\,[i_d\cos(\alpha) + i_q\sin(\alpha)] \end{bmatrix}$$

This state equation may be simplified by changing the variables to a per unit (p.u.) system according to the following definitions, with the per unit variables indicated with the prime designator (′):

$$i_d = i'_d i_b$$

$$i_q = i'_q i_b$$

$$v_{dc} = v_c' v_b$$

$$|v| = v' v_b$$

$$C = \frac{i_b}{\omega_b C' v_b}$$

$$L_s = \frac{L' v_b}{\omega_b i_b}$$

Thus, the state equation to model the ASVC system 20 may be given on a per unit basis as:

ASVC system Model Per Unit (′) d-q State Equation $$(p)\begin{bmatrix} i_d' \\ i_q' \\ v_c' \end{bmatrix} = \begin{bmatrix} 0 & \omega & 0 \\ -\omega & 0 & 0 \\ 0 & 0 & 0 \end{bmatrix}\begin{bmatrix} i_d' \\ i_q' \\ v_c' \end{bmatrix} + \frac{\omega_b}{L'}\begin{bmatrix} kv_c'\cos(\alpha) - v' \\ kv_c'\sin(\alpha) \\ \frac{-3kL'C'}{2}\,[i_d'\cos(\alpha) + i_q'\sin(\alpha)] \end{bmatrix}$$

Linearization of the ASVC Equations for Small Perturbations

The equations developed above for the ASVC system 20 are nonlinear if the angle $\alpha$ is regarded as an input variable. This nonlinearity may be avoided by considering only small deviations about a chosen system equilibrium point where the derivatives of the three state variables $i'_d$, $i'_q$ and $v'_c$ are all equal to zero Since the model developed thus far does not include any losses, the only equilibrium points for the ASVC system 20 occur when the angle $\alpha$ equals zero ($\alpha=0$). The conditions at these equilibrium points, as indicated with the subscript zero, are as follows:

Equilibrium Point Conditions $$\alpha = \alpha_o = 0$$

$$\omega = \omega_b$$

$$i'_q = i'_{qo}$$

$$v'_c = v'_{co}$$

$$v' = v'_o$$

$$v_{c0}' = \frac{1}{k}\,[v_0' - i_{q0}'L']$$

$$i_{d0}' = 0$$

Linearizing the ASVC system model state equations about an equilibrium point where $\alpha=0$ yields the following perturbation equations:

Linearized ASVC System Model Perturbation Equations $$(p)\begin{bmatrix} \Delta i_d' \\ \Delta i_q' \\ \Delta v_c' \end{bmatrix} = \begin{bmatrix} 0 & \omega_b & \frac{k\omega_b}{L'} \\ -\omega_b & 0 & 0 \\ \frac{-3k\omega_b C'}{2} & 0 & 0 \end{bmatrix}\begin{bmatrix} \Delta i_d' \\ \Delta i_q' \\ \Delta v_c' \end{bmatrix} + \begin{bmatrix} 0 & \frac{-\omega_b}{L'} \\ \frac{k\omega_b v_{c0}'}{L'} & 0 \\ \frac{-k\omega_b C'\, i_{q0}'}{2} & 0 \end{bmatrix}\begin{bmatrix} \Delta\alpha \\ \Delta v' \end{bmatrix}.$$

Figure 15:
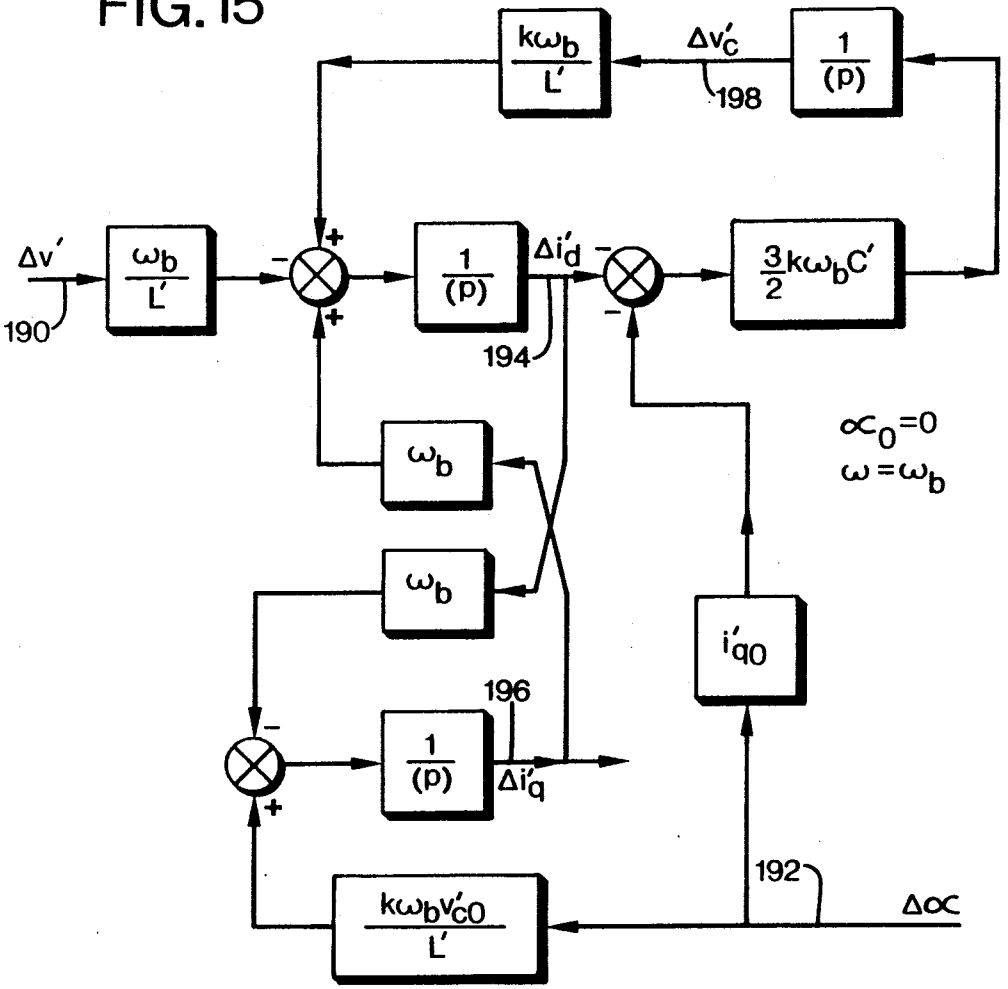
FIG. 15 is a block diagram of one form of a linearized model of the ASVC system of FIG. 1.

The linearized model, or "plant," of the ASVC system 20 described by the perturbation equation above is illustrated in block diagram form in FIG. 15. The model in FIG. 15 of the ASVC system 20 is used herein to define the problem of system dynamics which is solved by the illustrated operation of the ASVC controller 50. The controller 50 responds to a $\Delta v'$ change in line voltage 90, and $\Delta\alpha$ small changes in the inverter angle 92 about a given operating point, which are the values to the far right in the perturbation equations above. The resulting quantities of the perturbation equations, the $\Delta i_d'$ and $\Delta i_q'$ changes in the direct and quadrature currents, 94 and 96, respectively, as well as the $\Delta v_c'$ change in the DC side voltage 98 are also illustrated in FIG. 15. The illustrated output used herein for control purposes is the change in the instantaneous reactive current $\Delta i_q'$.

Derivation of System Transfer Functions

Using the perturbation equations derived from linearizing the system equations about an equilibrium point, frequency domain analysis techniques may be employed to obtain transfer functions of the ASVC system 20. However, each result of these transfer functions is valid only about a single operating point. Using Laplace transforms (indicated by the operator "s") and solving the perturbation equations, the following transfer functions are obtained:

ASVC System Transfer Functions $$\frac{\Delta I_d'}{\Delta\alpha(s)} = \frac{s[\omega_b L'' V_{c0}' - L''C'' i_{q0}']}{s[s^2 + \omega_b^2 + L''C'']}$$

$$\frac{\Delta I_q'}{\Delta\alpha(s)} = \frac{L''[s^2 + L''C''] v_{c0}' + [L''C''\omega_b] i_{q0}'}{s[s^2 + \omega_b^2 + L''C'']}$$

$$\frac{\Delta V_c'}{\Delta\alpha(s)} = \frac{-[L''C''\omega_b] v_{c0}' - [C''(s^2 + \omega_b^2)] i_{q0}'}{s[s^2 + \omega_b^2 + L''C'']}$$

where V and I are Laplace transforms of v and i, respectively, and:

$$L'' = \frac{k\omega_b}{L'}$$

$$C'' = \frac{3k\omega_b C'}{2}$$

The transfer functions above describe the response of the ASVC system 20 to the control input $\alpha$. The transfer functions above may be used to provide the basis for designing the structure of the balance of the ASVC controller 50.

Transfer Function Discussion

Figure 16:
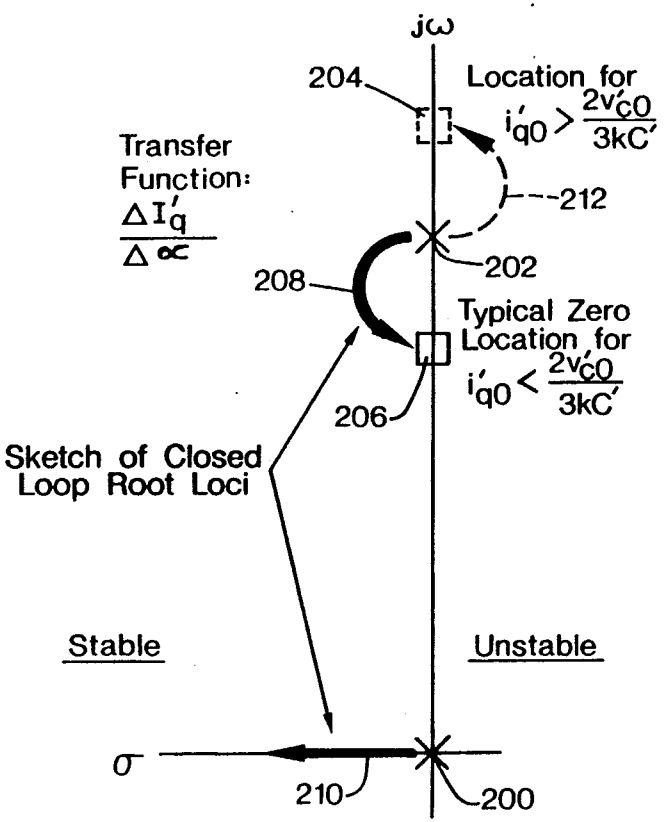
FIG. 16 is a graph of the transfer function relating the inverter angle $\alpha$ to the instantaneous reactive current of the ASVC system of FIG. 1.

The transfer functions above illustrate several features of the ASVC controller 50. Referring to FIG. 16, a graph of the transfer function $\Delta I'_q/\Delta\alpha$ is shown, with the horizontal axis labeled $\sigma$ representing the real axis in a complex plane, and the $j\omega$ axis representing the imaginary axis. As is standard in control theory, only the upper half of the complex plane is illustrated, and the lower half, which is a mirror image of the upper half, is omitted for clarity. Thus, each of the illustrated poles and zeros, other than those on the $\sigma$ axis, represent a pair of poles or zeros and are referred to as a pole pair or a zero pair, respectively.

In FIG. 16 the poles and zeroes of the transfer function $\Delta I_q'/\Delta\alpha$ are plotted. The poles located in the plane to the left of the $j\omega$ axis indicate a stable system, and those to the right of the $j\omega$ axis indicate an unstable system. The transfer function $\Delta I'_q/\Delta\alpha$ has a real pole 200 at the origin (s=0), and a complex pole pair 202 located on the $j\omega$ axis at:

$$s = \pm j\sqrt{\omega_b^2 + L''c''}\ .$$

For example, for one practical ASVC system 20, the resonant frequency associated with pole pair 202 may be calculated as follows:

$$k = \frac{8}{\pi}$$

$$L' = 0.12$$

$$c' = 0.32$$

$$\omega_b = 377$$

$$L'' = 8000$$

$$c'' = 461$$

For pole pair 202 located at $s = \pm j1957$, this resonant frequency is approximately 311 Hertz.

The transfer function $\Delta I'_q/\Delta\alpha$ in FIG. 16 also has a complex zero pair located on the $j\omega$ axis. The location of this zero pair depends on the chosen operating point. When $i'_{qo} = 2v'_{co} \div 3kC' = i'_{q(critical)}$, the zero pair is located in the same place as pole pair 202. When $i'_{qo} > i'_{qo(critical)}$, the zero pair is located further than pole pair 202 from the origin as indicated by zero pair 204. When $i'_{qo} < i'_{qo(critical)}$, the zero pair is located closer to the origin than pole pair 202 as indicated by zero pair 206.

In FIG. 16 the well known root locus method of classical control system theory is used to sketch the movement of the transfer function pole pair 202 and real pole 200 as a function of loop gain with a closed loop controller applied to the ASVC system 20. Two cases are shown. In the first case, $i'_{qo(critical)}, < i'_{qo(critical)}$, which yields two root loci 208 and 210. In this case, the control system is stable, as indicated from the root loci location, that is, both root loci 208 and 210 are located in the stable left half of the plane In the second case, $i'_{qo} > i'_{qo(critical)}$, and the root loci are 210 and 212. Since the root loci 212 is located in the right half of the complex plane, an unstable control system is predicted. Thus, it is preferable to operate in the stable region of operation, here, where $i'_{qo} < i'_{qo(critical)}$.

Closed Loop Control Structure in the ASVC Controller

The preceding analysis and discussion serves to illustrate the problem encountered in finding a suitable structure for the ASVC controller 50, that is, if the control structure is not carefully selected, unstable operation will result. The illustrated ASVC controller 50 solves this problem by having a closed loop control structure that has two feedback quantities. One is an $i'_q$ feedback quantity, and the other is a new synthesized feedback quantity q. This synthesized feedback quantity q is determined as follows:

Synthesized Feedback Signal $$q = [i_q' - i_{q0(critical)}'] \left[\frac{s}{1 + sT}\right] [v_c']$$

This synthesized feedback quantity q has the effect of relocating the open loop transfer function zeroes to locations, such as zero pair 206 in FIG. 16, so that the closed loop root locus is always in the left half plane, indicating stable operation.

To determine the synthesized feedback quantity q, the illustrated ASVC controller 50 has a DC voltage signal per unit ("p.u.") transformation portion 156 which receives the DC voltage signal 56 from the DC voltage sensor 55 and transforms it into a $v_c'$ per unit DC voltage signal 158. The $i'_{qo(critical)}$ function above is implemented in the illustrated ASVC controller 50 by a $(2 \div 3kC')$ multiplier portion 160 which receives the $v_c'$ signal 158, and in response thereto, produces an $i'_{qo(critical)}$ output signal 162.

The illustrated ASVC controller 50 has a first comparator portion 164 which subtracts the $i'_{qo(critical)}$ signal 162 from the $i'_q$ signal 155, received from the transformation portion 155, to provide an output of an $i'_{qo}<i'_{qo(critical)}$ signal 166. A $[(k_3s)\div(1+sT)]$ Laplace transform function portion 168 receives the $v'_c$ signal 158, and performs the Laplace transform function as shown in FIG. 6 to produce a $[(k_3s)(v'_c)\div(1+sT)]$ output signal 170 having a gain of $k_3$. A multiplier portion 172 multiplies the $i'_{qo}<i'_{qo(critical)}$ signal 166 by signal 170 to produce a dynamic stabilizing feedback signal, such as a $k_3q$ amplified synthesized feedback or error signal 174.

The preceding expression for the synthesized feedback quantity q includes a time constant parameter T in the Laplace transform function portion 168. The value of the time constant parameter T is not critical to assure stability, but rather, is chosen for a particular implementation to satisfy system performance specifications of the power system 24. For example, in practical implementations of a scaled model prototype, a value of $T=0.004$ has been used successfully.

To determine the second loop for the feedback quantity $i'_q$, the illustrated ASVC controller 50 receives an $i'_q{}^*$ reference signal 52. The $i'_q{}^*$ signal 52 is the desired instantaneous value of the instantaneous reactive current to be drawn from the transmission line 22. In a practical implementation, the $i'_q{}^*$ reference signal 52 may be generated by other control apparatus, such as a higher level controller (not shown), responsible for maintaining, for example, the voltage at the point of connection of the ASVC system 20 to the line 22. A second comparator portion 176 subtracts the $i'_q$ signal 155 from the $i'_q{}^*$ reference signal 52 to provide an output of a $(i'_q{}^*-i'_q)$ signal 166.

In order to track the $i'_q{}^*$ reference signal 52 with substantially zero error under steady state conditions, rather than using a proportional gain term $K_1$ associated with $i'_q$ feedback the illustrated controller 50 has a proportional-plus-integral gain portion 180. The portion 180 applies the Laplace function $(K_1+K_2/s)$ to the $(i'_q{}^*-i'_q)$ signal 166 to produce an $i'_q$ error or feedback signal 182. This change slightly modifies the dynamic response of the ASVC system 20 but does not detract from its advantageous features.

For the two feedback quantities q and $i'_q$ in the ASVC controller 50, the gains are referred to as $k_1$ for the $i'_q$ feedback signal 182 and $k_3$ for synthesized $k_3q$ feedback signal 174. These gains may be established at their optimum values for different inverter systems and different performance specifications, as is commonly done in industrial control systems, in the manner known to those skilled in the art, once the basic control loop structure described for controller 50 is known. It is apparent to those skilled in the art that the Laplace transform function portions 122, 168 and 180 of the controller 50 each receive a time domain signal, perform the Laplace transform as shown in FIGS. 6 and 10, and transforms the result back into the time domain as an output signal.

The controller 50 has an output portion for combining the $i'_q$ feedback signal 182 the $k_3q$ signal 174 and the $\theta$ signal 128 to provide the inverter control signal 54. In the illustrated controller 50, the $i'_q$ feedback signal 182 and the $k_3q$ signal 174 are added together by a third comparator portion 183 to produce a phase angle $\alpha$ signal 184. The $\alpha$ signal 184 defines the phase of the AC output voltage of the inverter 30 relative to the transmission line voltage. A fourth comparator 185 adds the angle $\alpha$ signal 184 to the $\Theta$ signal 128, which represents the instantaneous phase angle of the line voltage, to obtain an angle $\beta$ signal 186. The $\beta$ signal 186 represents the instantaneous phase angle required for the AC output voltage of the inverter 30 in the fixed plane of FIG. 3, rather than the rotating planes of FIGS. 9 and 12.

In practice, the output voltage of the inverter 30 has a phase angle that is uniquely defined by the combination of switching states assumed by its internal power switches (not shown). For each phase angle $\beta$, an appropriate combination of switching states may be stored for access from look-up table memory, such as an inverter switching state look-up table portion 188. The angle $\beta$ signal 186 may be used to index the required combination of inverter switch states within this look-up table portion 188 to provide the inverter control signal 54. It is apparent that alternatively, the look-up table portion 188 may be incorporated into the inverter (not shown), in which case, the inverter control signal 54 would correspond to the $\beta$ signal 186.

The controller 50 preferred embodiment in FIG. 6 advantageously provides a stable and fast responding control of the instantaneous reactive current $i_q$ flowing through the line 22. The illustrated ASVC system 20 has been reduced to practice in the form of a complete scaled analog model of an 80 MVAR transmission line compensator. In this prototype, the preferred embodiment demonstrated the ability to drive the reactive current between rated capacitive value and rated inductive value in about a quarter of a cycle of the line frequency of 60 Hz, that is, in approximately four milliseconds.

Having illustrated and described the principles of my invention with respect to a preferred embodiment, it should be apparent to those skilled in the art that my invention may be modified in arrangement and detail without departing from such principles. For example, other structurally equivalent inverters could be substituted for the simple voltage sourced inverter 30, as known by those skilled in the art. Furthermore, the ASVC controller 50 may be implemented in a variety of ways, using hardware, software, digital and/or analog technologies, or combinations thereof known to those skilled in the art. I claim all such modifications falling within the scope and spirit of the following claims.

I claim:

1. An advanced static VAR compensator system for coupling to an AC power line for compensating reactive power losses of the line, the control system comprising:

a voltage sourced inverter having a DC side and an AC side for coupling to the line, the inverter responsive to an inverter phase angle control signal for drawing a selected magnitude of reactive power from the line;

a series inductance coupled to the AC side of the inverter for coupling the inverter to the line;

a voltage supporting device coupled to the DC side of the inverter;

a DC voltage sensor apparatus for monitoring a DC voltage across the voltage supporting device;

an AC parameter sensor apparatus coupled between the inverter and the line for monitoring an electrical characteristic, including AC current, therebetween; and a controller responsive simultaneously to the monitored AC current and DC voltage for generating an instantaneous reactive current signal and for generating in response thereto the inverter phase angle control signal.

2. An advanced static VAR compensator system according to claim 1 wherein the controller is responsive to the DC voltage sensor for generating a dynamic inverter phase angle control signal for dynamically controlling the inverter.

3. An advanced static VAR compensator system according to claim 2 wherein the controller is responsive to the DC voltage sensor and the instantaneous reactive current signal for synthesizing a dynamic stabilizing feedback signal and for generating in response thereto the inverter phase angle control signal.

4. An advanced static VAR compensator system according to claim 1 wherein the AC parameter sensor apparatus comprises:

a pair of AC voltage sensors for monitoring two line to line voltages of the AC power line; and a pair of AC current sensors for monitoring two phases currents flowing between the inverter and the line when coupled therewith.

5. An advanced static VAR compensator system according to claim 4 wherein the pair of AC voltage sensors monitor two line to line at the line side of the series inductance.

6. An advanced static VAR compensator system according to claim 4 wherein the controller comprises:

a input portion responsive to the pair of AC voltage sensors and the pair of AC current sensors for generating the instantaneous reactive current signal to be synchronized with the line voltage;

a comparator portion responsive to the instantaneous reactive current signal and an instantaneous reactive current reference signal for generating a first error signal; and an output portion responsive to the first error signal and the DC voltage sensor for generating the inverter phase angle control signal.

7. An advanced static VAR compensator according to claim 1 wherein the series inductance comprises the inductance of a coupling transformer for coupling the inverter to the line.

8. An advanced static VAR compensator system according to claim 1 wherein the voltage supporting device comprises a capacitor.

9. An advanced static VAR compensator system according to claim 1 wherein the voltage sourced inverter comprises a simple inverter having only phase angle control capability.

10. An advanced static VAR compensator system for coupling to a power line for compensating reactive power losses of the line, the control system comprising:

a voltage sourced inverter having a DC side and an AC side for coupling to the line, the inverter responsive to an inverter phase angle control signal for drawing a selected magnitude of reactive power from the line;

a series inductance coupled to the AC side of the inverter for coupling the inverter to the line;

a voltage supporting device coupled to the DC side of the inverter;

an AC parameter sensor apparatus coupled between the inverter and the line for monitoring an electrical characteristic therebetween, with the AC parameter sensor apparatus comprising a pair of AC voltage sensors for monitoring two line to line voltages of the line, and a pair of AC current sensors for monitoring two phase currents flowing between the inverter and the line when coupled therewith;

a DC voltage sensor for monitoring a voltage of the voltage supporting device; and a controller responsive to the AC parameter sensor apparatus for generating an instantaneous reactive current signal and for generating in response thereto the inverter phase angle control signal, with the controller including:

a vector resolver portion responsive to the pair of AC voltage sensors for generating direct and quadrature voltage signals;

a vector phase locked loop portion responsive to the direct and quadrature voltage signals for generating a first angle signal;

a rotating axis transformation portion responsive to the pair of AC current sensors and the first angle signal for generating the instantaneous reactive current signal;

an instantaneous reactive current feedback portion responsive to the instantaneous reactive current signal and a reactive current reference signal to generate an instantaneous reactive current feedback signal;

a synthesized feedback portion responsive to the DC voltage sensor and the instantaneous reactive current signal for generating a synthesized feedback signal; and an output portion responsive to the first angle signal, the instantaneous reactive current feedback signal, and the synthesized feedback signal for generating the inverter phase angle control signal.

11. A method of compensating reactive power losses of a power line, comprising the steps of:

coupling an AC side of a voltage sourced inverter to the transmission line through a series inductance, and coupling a DC voltage supporting device to a DC side of the inverter, the inverter responsive to an inverter phase angle control signal;

first monitoring the AC current flowing between the inverter and the power line;

second monitoring the AC line voltage of the power line;

third monitoring the DC voltage across the DC voltage supporting device; and controlling a phase displacement angle between an AC terminal voltage at the AC side of the inverter and the line voltage by generating an instantaneous reactive current signal in simultaneous response to the first, second and third monitoring steps for generating the inverter phase angle control signal.

12. A method of compensating reactive power losses of a power line according to claim 11 wherein:

the method further includes a third monitoring step of monitoring a DC voltage of the voltage supporting device; and the controlling step comprises the step of generating the inverter phase angle control signal in response to the third monitoring step.

13. A method of compensating reactive power losses of a power line according to claim 12 wherein:

the controlling step comprises the step of comparing the instantaneous reactive current signal with a reference signal to generate a reactive current error signal; and the controlling step comprises the step of generating the inverter phase angle control signal in response to the reactive current error signal.

14. A method of compensating reactive power losses of a power line according to claim 13 wherein:

the controlling step comprises the step of synthesizing a synthesized feedback signal in response to the instantaneous reactive current signal and the third monitoring step; and the controlling step comprises the step of generating the inverter phase angle control signal in response to the synthesized feedback signal.

15. An advanced static VAR compensator controller inverter apparatus for coupling between a DC voltage supporting device and an AC power line, comprising:

a voltage sourced inverter having a DC side for coupling to the DC voltage supporting device and an AC side for coupling to the line, the inverter responsive to an inverter phase angle control signal for drawing a selected magnitude of reactive power from the line;

an AC parameter sensor apparatus coupled between the inverter and the line for monitoring an electrical characteristic, including AC current, therebetween;

a DC voltage sensor apparatus for monitoring a DC voltage across the voltage supporting device; and a controller for simultaneously combining the monitored AC current and DC voltage on an instantaneous basis in a nonlinear fashion for generating an instantaneous reactive current signal and for generating in response thereto the inverter phase angle control signal.

16. An advanced static VAR compensator controller for controlling an inverter coupled between a DC voltage supporting device and an AC power line, the inverter responsive to an inverter phase angle control signal, with a pair of AC voltage sensors for monitoring two line to line voltages of the AC power line, a pair of AC current sensors for monitoring two phase currents flowing between the inverter and the line, and a DC voltage sensor for monitoring a DC voltage across the voltage supporting device, the controller comprising:

an input portion responsive to the pair of AC voltage sensors and the pair of AC current sensors for generating an instantaneous reactive current signal;

a comparator portion responsive to the instantaneous reactive current signal and an instantaneous reactive current reference signal for generating a first error signal; and an output portion responsive to the first error signal and the DC voltage sensor for generating the inverter phase angle control signal.

17. An advanced static VAR compensator controller according to claim 16 wherein the input portion comprises:

a vector resolver portion responsive to the pair of AC voltage sensors for generating direct and quadrature voltage signals;

a vector phase locked loop portion responsive to the direct and quadrature voltage signals for generating a first angle signal; and a rotating axis transformation portion responsive to the pair of AC current sensors and the first angle signal for generating the instantaneous reactive current signal.

18. An advanced static VAR compensator controller according to claim 17 wherein:

the comparator portion comprises an instantaneous reactive current feedback portion responsive to the instantaneous reactive current signal and a reactive current reference signal to generate an instantaneous reactive current feedback signal; and the controller further includes a synthesized feedback portion responsive to the DC voltage sensor and the instantaneous reactive current signal for generating a synthesized feedback signal.

19. An advanced static VAR compensator system for coupling to a power line for compensating reactive power losses of the line, the control system comprising:

a voltage sourced inverter having a DC side and an AC side for coupling to the line, the inverter responsive to an inverter control signal for drawing a selected magnitude of reactive power from the line;

a voltage supporting device coupled to the DC side of the inverter;

a DC voltage sensor for monitoring a DC voltage of the voltage supporting device;

an AC parameter sensor apparatus coupled between the inverter and the line for monitoring an electrical characteristic, including AC current, therebetween; and a controller simultaneously responsive to the monitored AC current and the DC voltage on an instantaneous basis for making a combination in a nonlinear fashion for generating the inverter control signal.

20. An advanced static VAR compensator system according to claim 19 wherein the controller generates an instantaneous reactive current signal in response to the AC parameter sensor apparatus, and a synthesized feedback signal in response to the instantaneous reactive current signal and the DC voltage sensor for generating the inverter control signal.

21. An advanced static VAR compensator controller system according to claim 1 wherein the controller is responsive vectorially to the monitored AC current and DC voltage on an instantaneous basis for generating the inverter phase angle control signal.

22. An advanced static VAR compensator system according to claim 1 wherein the controller is responsive to the monitored AC current and DC voltage on an instantaneous basis in a nonlinear fashion for generating the inverter phase angle control signal.

* * * * *